US009732459B2

(12) United States Patent
Kim et al.

(10) Patent No.: US 9,732,459 B2
(45) Date of Patent: Aug. 15, 2017

(54) GASKET USABLE WITH WASHING MACHINE AND WASHING MACHINE HAVING THE SAME

(71) Applicant: SAMSUNG ELECTRONICS CO., LTD., Suwon-si (KR)

(72) Inventors: Dong Won Kim, Suwon-si (KR); Jong Won Park, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 941 days.

(21) Appl. No.: 13/955,595

(22) Filed: Jul. 31, 2013

(65) Prior Publication Data

US 2014/0069147 A1 Mar. 13, 2014

(30) Foreign Application Priority Data

Jul. 31, 2012 (KR) ..... 10-2012-0084223
Jul. 5, 2013 (KR) ..... 10-2013-0079101

(51) Int. Cl.
*D06F 37/26* (2006.01)

(52) U.S. Cl.
CPC ..... *D06F 37/266* (2013.01)

(58) Field of Classification Search
CPC ..... D06F 37/266; D06F 39/14; D06F 25/00; D06F 37/22; D06F 58/04; D06F 37/263
(Continued)

(56) References Cited

U.S. PATENT DOCUMENTS 7,398,662 B2 * 7/2008 Kim ..... D06F 39/14 134/200
2004/0103693 A1 6/2004 Kim et al.
(Continued)

FOREIGN PATENT DOCUMENTS

DE 10 2007 012 136 3/2007
EP 0 657 574 11/1994
(Continued)

OTHER PUBLICATIONS

European Office Action for corresponding European Application 13178755.8-1710; dated Sep. 27, 2013.
(Continued)

*Primary Examiner* — David Cormier
*Assistant Examiner* — Thomas Bucci
(74) *Attorney, Agent, or Firm* — Staas & Halsey LLP

(57) ABSTRACT

A gasket usable with a washing machine capable of reinforcing the strength thereof while improving the vibration reducing performance of the gasket, a gasket connecting a tub to the front surface frame, wherein the gasket includes a body having a hollowness part configured to accommodate a portion of the door and a periphery part configured to surround the hollowness part, and a reinforcing rib formed by protruding at least one portion of the periphery part so as to reinforce a strength of the gasket, and wherein the reinforcing rib has a rear surface further concaved than an inner surface of the periphery part that is adjacent to the rear surface. The gasket further comprise a connection lip that contacts the closed door, such that the connection lip has a connection rib having a greater thickness in the lower portion of the lip than the upper portion of the lip.

8 Claims, 17 Drawing Sheets

(58) Field of Classification Search
USPC ..... 68/24, 140, 3 R, 139, 23.1, 142, 212, 68/253 C, 269 R, 23 A, 5 E, 16; 220/378, 220/608, 849, 304, 62.18, 319, 324, 833, 220/214, 23.87, 254.1; 312/228, 296, 312/229, 263, 265.5, 109
See application file for complete search history.

(56) References Cited

U.S. PATENT DOCUMENTS

| | | | | |
|---|---|---|---|---|
| 2005/0178168 | A1* | 8/2005 | Kim ..... | D06F 37/266 68/23.1 |
| 2005/0178170 | A1 | 8/2005 | Kim et al. | |
| 2005/0262879 | A1 | 12/2005 | Kim et al. | |
| 2006/0174663 | A1 | 8/2006 | Cimetta et al. | |
| 2009/0165505 | A1 | 7/2009 | Bobed | |

FOREIGN PATENT DOCUMENTS

| | | | |
|---|---|---|---|
| EP | 0 672 778 | | 3/1998 |
| EP | 1 964 961 | | 9/2008 |
| KR | 10-2006-0036755 | | 5/2006 |
| KR | 10-2008-0002477 | | 1/2008 |
| KR | 20080002477 | A * | 1/2008 |
| KR | 10-2008-0072188 | | 8/2008 |
| WO | 2010/038931 | | 4/2010 |

OTHER PUBLICATIONS

PCT International Search Report issued Oct. 18, 2013 in corresponding International Application No. PCT/KR2013/006847.
Chinese Office action issued on Jan. 17, 2017 in corresponding Chinese Patent Application No. 201310329821.5.
Decision on Grant issued on Nov. 24, 2016 in corresponding European Patent Application No. 13 178 755.8.

* cited by examiner

GASKET USABLE WITH WASHING MACHINE AND WASHING MACHINE HAVING THE SAME

CROSS-REFERENCE TO RELATED APPLICATIONS

This application claims the benefit of Korean Patent Applications No. 10-2012-0084223, filed on Jul. 31, 2012 and No. 10-2013-0079101, filed on Jul. 5, 2013 in the Korean Intellectual Property Office, the disclosures of which are incorporated herein by reference.

BACKGROUND

1. Field

Embodiments of the present disclosure relate to a gasket, and more particularly, to a gasket that is applicable to a washing machine.

2. Description of the Related Art

A washing machine is a machine configured to treat laundry, such as clothes and bed clothes, by use of electric power. The washing machine includes a washer configured to remove dirt from the laundry by use of interaction among water, detergent and a rotating drum, and a drier configured to dry the wet laundry by use of wind that is heated by a heater.

The washing machine includes a cabinet having an opening through which laundry is inserted, a door configured to open and close the opening of the cabinet, a tub disposed at an inside the cabinet to store water, and a drum rotatably installed at an inside the tub. When the drum is rotated by a motor in a state of the laundry and the detergent water being inserted in the drum, the laundry is in friction with the drum and the detergent water so that dirt can be removed from the laundry.

A gasket is installed between the cabinet and the tub to prevent leakage of water while preventing vibration from being transmitted to the cabinet at the time of rotation of the drum.

The gasket, which is connected to the tub, is deformed by the movement of the tub occurring at the time of rotation of the drum. During a washing cycle, the tub connected to the drum may be vibrated according to the rotation of the drum and the uneven distribution of the laundry, which occurs along with the rotation of the drum. In a process of absorbing the vibration of the tub, the gasket is deformed starting from a portion at which the tub is connected to the gasket. In addition, the tub may be vibrated due to a high speed rotation of the drum during a spin-dry cycle, and in a process of absorbing the vibration of the tub, the gasket is deformed starting from a portion at which the tub is connected to the gasket.

If the deformation of the gasket occurring at the washing cycle and the spin-dry cycle is severe, the gasket comes upon a self-touch. As the self-touch continues, the gasket has abrasion and perforation, so that wash water may be leaked to the outside of the tub.

SUMMARY

Therefore, it is an aspect of the disclosure to provide a gasket usable with a washing machine capable of reinforcing the strength thereof while improving the vibration reducing performance of the gasket, and a washing machine having the same.

Additional aspects will be set forth in part in the description which follows and, in part, will be obvious from the description, or may be learned by practice of the disclosure.

In accordance with one embodiment, a washing machine includes a cabinet, a door, a tub, a drum and a gasket. The cabinet may include a front surface frame through which an opening is formed. The door may be installed at the cabinet to open and close the opening. The tub may be disposed at an inside the cabinet. The drum may be rotatably disposed at an inside the tub. The gasket may connect the tub to the front surface frame so as to inhibit vibration of the tub from being transmitted to the front surface frame when the drum rotates. The gasket may include a body and a reinforcing rib. The body may have a hollowness part configured to accommodate a portion of the door and a periphery part configured to surround the hollowness part. The reinforcing rib may be formed by protruding at least one portion of the periphery part so as to reinforce strength of the gasket. The reinforcing rib may have a rear surface further concaved than an inner surface of the periphery part that is adjacent to the rear surface.

The reinforcing rib may be provided in at least two units thereof that are disposed while being spaced apart from each other in a circumferential direction of the periphery part.

The reinforcing rib may be provided in a form of a rectangular band that winds around the periphery part.

The body may include a first body part coupled to the front surface frame, a second body part coupled to the tub, and a connection part connecting the first body part to the second body part.

The reinforcing rib may be formed on at least one portion of the first body part.

The reinforcing rib may be formed on at least one portion of the second body part.

The reinforcing rib may be formed on at least one portion of the first body part and the connection part.

The reinforcing rib may be formed on at least one portion of the second body part and the connection part.

The reinforcing rib may have a thickness substantially identical to a thickness of the connection part.

The reinforcing rib may have a thickness thinner than a thickness of the connection part.

In accordance with an aspect, a gasket connecting a cabinet of a washing machine to a tub disposed at an inside the cabinet includes a cabinet coupling part, a tub, a connection part, and a plurality of ribs. The cabinet coupling part may be coupled to a first opening that is formed through the cabinet. The tub coupling part may be coupled to a second opening that is formed through the tub. The connection part may connect the cabinet coupling part to the tub coupling part. The plurality of ribs may be composed of an injection molded product that is made from a thermoplastic elastomer. The plurality of ribs may be formed by protruding an outer surface and a rear surface of at least one portion of the connection part toward an outer side of the connection part. The plurality of ribs may be disposed while being spaced apart from each other in a circumferential direction of the connection part.

An amount by which the outer surface of the rib protrudes toward the outer side of the connection part may be substantially identical to an amount by which the rear surface of the rib protrudes toward the outer side of the connection part.

An amount by which the outer surface of the rib may protrude toward the outer side of the connection part is less than an amount by which the rear surface of the rib protrudes toward the outer side of the connection part.

The rib may have a shape of a rectangular band that is elongated along the connection part in a direction at which the connection part connects the cabinet coupling part to the tub coupling part.

The rib may be provided at an outer surface thereof with a convex part bulging when compared to an outer surface of the connection part, and at a rear surface thereof corresponding to the outer surface of the rib with a concave part concaved when compared to an inner surface of the connection part.

The concave part may have a depth larger than a height of the convex part.

In accordance with another aspect, a washing machine includes a cabinet, a door, a tub, a drum, and a gasket. The cabinet may include a front surface frame through which an opening is formed. The door may be installed at the cabinet to open and close the opening. The tub may be disposed at an inside the cabinet. The drum may be rotatably disposed at an inside the tub. The gasket may connect the tub to the front surface frame so as to inhibit vibration of the tub from being transmitted to the front surface frame when the drum rotates. The gasket may include a body, a lip, and a connection rib. The body may have a hollowness part configured to accommodate a portion of the door and a periphery part configured to surround the hollowness part. The lip may be formed at a front end of the periphery part along a circumferential direction of the periphery part, and configured to prevent wash water in the tub from leaking outside, by making contact with the door. The connection rib may be configured to connect a rear surface of the lip to an inner surface of the periphery part. The connection rib may include a first portion having a first cross section along a circumferential direction of the lip, and a second portion having a second cross section larger than the first cross section along the circumferential direction of the lip.

The connection rib may include a third portion that connects the first portion to the second portion, and has a cross section continuously varying along the circumferential direction of the lip.

The first portion may form an upper portion of the connection rib, and the second portion may form a lower portion of the connection rib.

The first portion may have a length that is longer than a length of the second portion along the circumferential direction of the lip.

In accordance with another aspect, a gasket connecting a cabinet of a washing machine to a tub disposed at an inside the cabinet, the gasket including a cabinet, a tub, a connection part, a lip, and a round part. The cabinet coupling part may be coupled to a first opening that is formed through the cabinet. The tub coupling part may be coupled to a second opening that is formed through the tub. The connection part may connect the cabinet coupling part to the tub coupling part. The lip may protrude from an inner surface of the connection part toward a center of the gasket while being formed in a ring shape along a circumferential direction of the gasket. The round part may be formed between a rear surface of the lip and the inner surface of the connection part. The round part may include a first portion and a second portion that have different radiuses from each other.

The round part may include a third portion disposed between the first portion and the second portion and having a radius continuously varying along a circumferential direction of the lip.

The first portion may form an upper portion of the round part, and the second portion may form a lower portion of the round part.

The first portion may have a radius smaller than a radius of the second portion.

The round part may have a radius of about 1 mm or above and about 9 mm or below.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
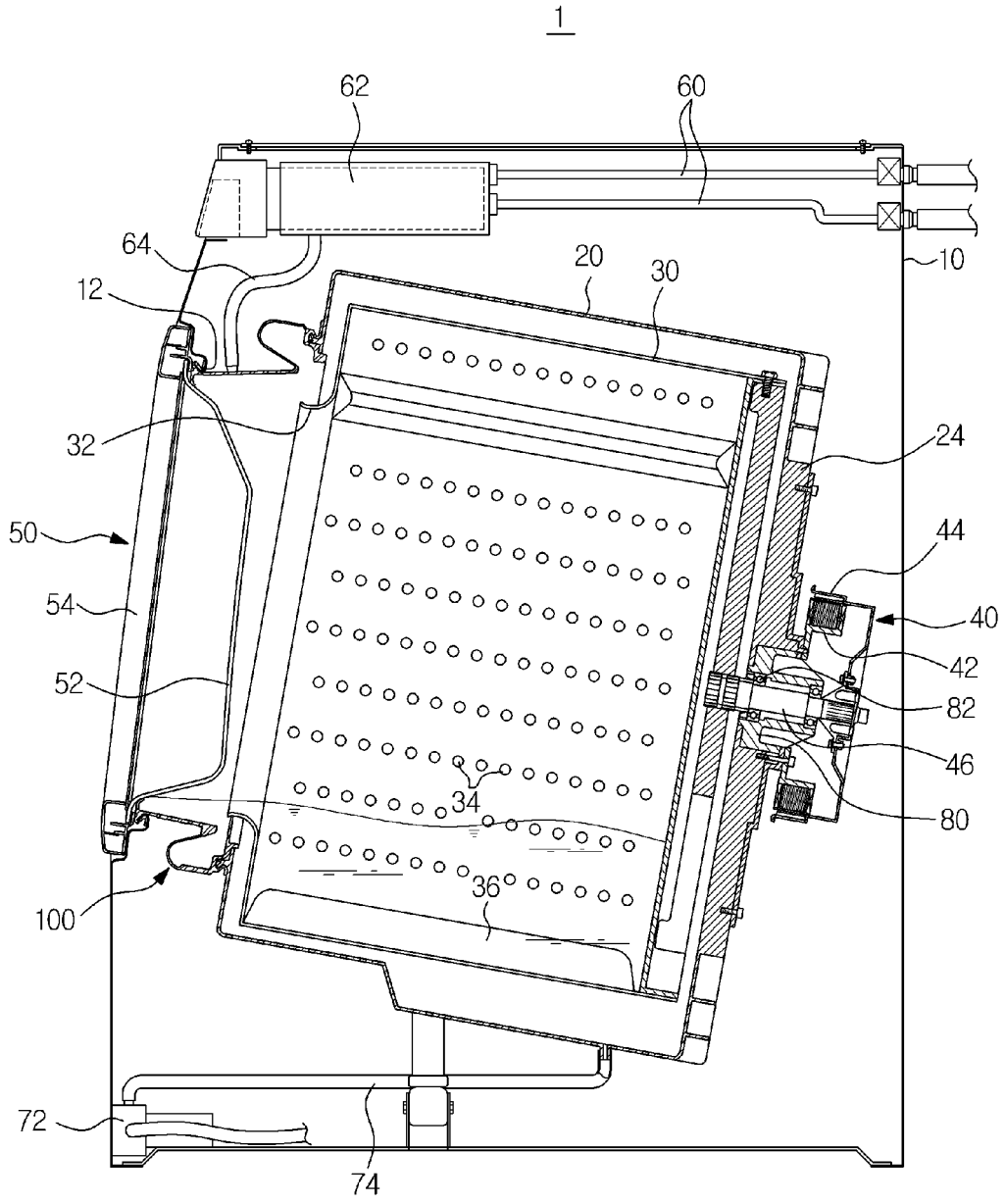
FIG. 1 is a drawing illustrating a washing machine in accordance with one embodiment.

Reference will now be made in detail to the embodiments, examples of which are illustrated in the accompanying drawings, wherein like reference numerals refer to like elements throughout.

Figure 2:
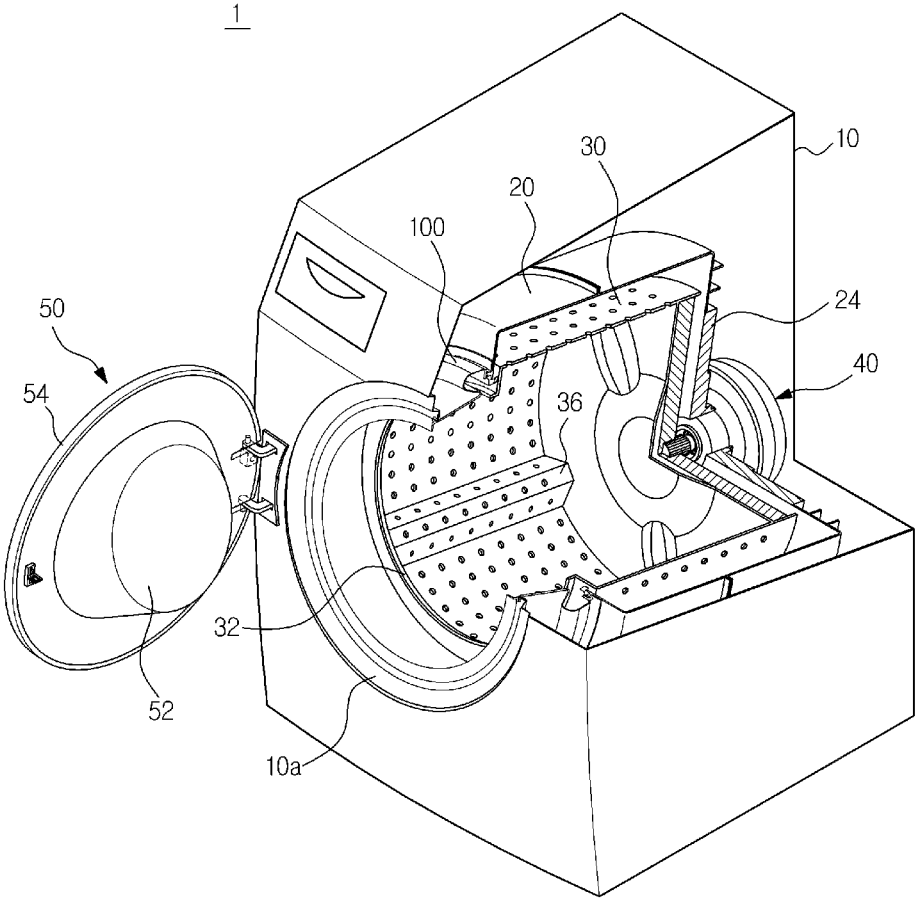
FIG. 2 is a drawing of a cut portion of the washing machine in accordance with one embodiment.

FIG. 1 is a drawing illustrating a washing machine in accordance with one embodiment. FIG. 2 is a drawing of a cut portion of the washing machine in accordance with one embodiment.

Referring to FIGS. 1 and 2, a washing machine 1 includes a cabinet 10 forming the external appearance of the washing machine 1, a tub 20 installed at an inside the cabinet 10 to store water, a drum 30 rotatably disposed at an inside the tub 20, and a motor 40 to drive the drum 30.

An opening 12 is formed through a front surface frame 10*a* of the cabinet 10. The opening 12 of the front surface frame 10*a* is open and closed by a door 50 installed at the front surface frame 10*a*. The door 50 is provided with a door glass 52 allowing the interior of the drum 30 to be seen therethrough, and a door frame 54 to support the door glass 52.

Openings 22 and 32 are formed at a front surface part of the tub 20 and a front surface part of the drum 30, respectively, while corresponding to the opening 12 of the front surface frame 10*a* such that laundry is inserted to the inside of the drum 30 through the openings 22 and 32.

A water supply pipe 60 is installed at an upper portion of the tub 20 to supply wash water to the tub 20. One side of the water supply pipe 60 is connected to an outside water supply source (not shown), and the other side of the water supply pipe 60 is connected to a detergent supply apparatus 62. The detergent supply apparatus 62 is connected to the tub 20 through a connection pipe 64. The water being supplied through the water supply pipe 60 is supplied to the inside of the tub 20 together with detergent via the detergent supply apparatus 62.

A drain pump 72 and a drain pipe 74 are installed at a lower portion of the tub 20 to discharge water of the tub 20 to the outside the cabinet 10.

A plurality of through holes 34 is formed at a circumference of the drum 30 to circulate wash water, and a plurality of lifter 36 is installed at an inner circumferential surface of the drum 30 such that laundry ascends and descends when the drum 30 rotates.

The motor 40 is mounted at a rear wall 24 of the tub 20. The motor 40 includes a stator 42 fixed to the tub 20, and a rotor 44 rotatably disposed around the stator 42. The rotor 44 rotates while electromagnetically interacting with the stator 42, thereby transmitting a rotary force to a driving shaft 46.

The driving shaft 46 transmits a rotary shaft of the motor 40 to the drum 30. One end of the driving shaft 46 is connected to the drum 30, and the other end of the driving shaft 46 extends to the outside the rear wall 24 of the tub 20 and is coupled to the robot 44.

A bearing housing 80 is installed at the rear wall 24 to rotatably support the driving shaft 46. The bearing housing 80 is composed of an aluminum alloy, and is inserted into the rear wall 24 of the tub 20 when the tub 20 is injection molded. Bearings 82 are installed between the bearing housing 80 and the driving shaft 46 so that the driving shaft 46 is smoothly rotated.

A gasket 100 is installed between the tub 20 and the door 50. The gasket 100 is disposed between the opening 12 of the front surface frame 10*a* and the opening 22 of the tub 20 so as to form a path leading from the opening 12 of the front surface frame 10*a* to the opening 32 of the drum 30, thereby reducing vibration being transmitted to the front surface frame 10*a* when the drum 30 rotates. One portion of the gasket 100 is disposed between the door 50 and the front surface frame 10*a* to prevent water of the tub 20 from leaking to the outside the cabinet 10.

The gasket 100 may be composed of an injection molded product made from a thermoplastic elastomer. Since the thermoplastic elastomer has elasticity at room temperature such as in rubber, the gasket 100 made from the thermoplastic elastomer may effectively attenuates the transfer of vibration from the tub 20 to the front surface frame 10*a* of the cabinet 10.

Composition providing material for the gasket 100 includes a hydrogenated styrene block copolymer. The hydrogenated styrene block copolymer may include one or more selected from a group consisting of styrene-ethylene-butylene-styrene (SEBS), styrene-ethylene-propylene-styrene (SEPS), and styrene-ethylene-ethylene-propylene-styrene (SEEPS).

Petroleum softener may be added to the composition for the gasket 100 in order to lower hardness of the thermoplastic elastomer composition. Naphthenic oil or paraffin oil may be used as the petroleum softener.

The softener content may be in a range of 70 parts by weight to 99 parts by weight relative to 100 parts by weight of the styrene block copolymer. If the softener content is below 70 parts, low hardness required for the gasket is difficult to be attained. If the softener content exceeds 99 parts, the elastomer comes up to oil bleeding and becomes sticky, leading to contamination. In addition, after a long duration of time, the elastomer becomes stiff.

In addition, polyolefin may be added to the composition for the gasket so as to improve the thermal resistance of the thermoplastic elastomer composition. The polyolefin may be one or more selected from the group consisting of liner and non-liner polyethylene and polypropylene. In order to improve the thermal resistance, the polypropylene is preferred.

The polyolefin content may be in a range of 10 parts by weight to 25 parts by weight relative to 100 parts by weight of the styrene block copolymer. If the polyolefin content is below 10 parts, thermal resistant is not sufficiently attained, and if the polyolefin content exceeds 25 parts, the elastic restoration force of the elastomer is lowered.

Heat resistant polymer may be added to the composition for the gasket in order to improve high-temperature tensile strength and high-temperature stretch deformation rate of the thermoplastic elastomer. Polyphenyleneoxide (PPO), polyphenylene ether (PPE), a modified PPO or a modified PPE may be used as the heat resistant polymer.

The heat resistant polymer content may be in a range of 10 parts by weight to 25 parts by weight relative to 100 parts by weight of the styrene block copolymer. If the heat resistant polymer content is below 10 parts or exceeds 25 parts, the high-temperature tensile strength and the high-temperature restoration are significantly lowered.

Figure 3:
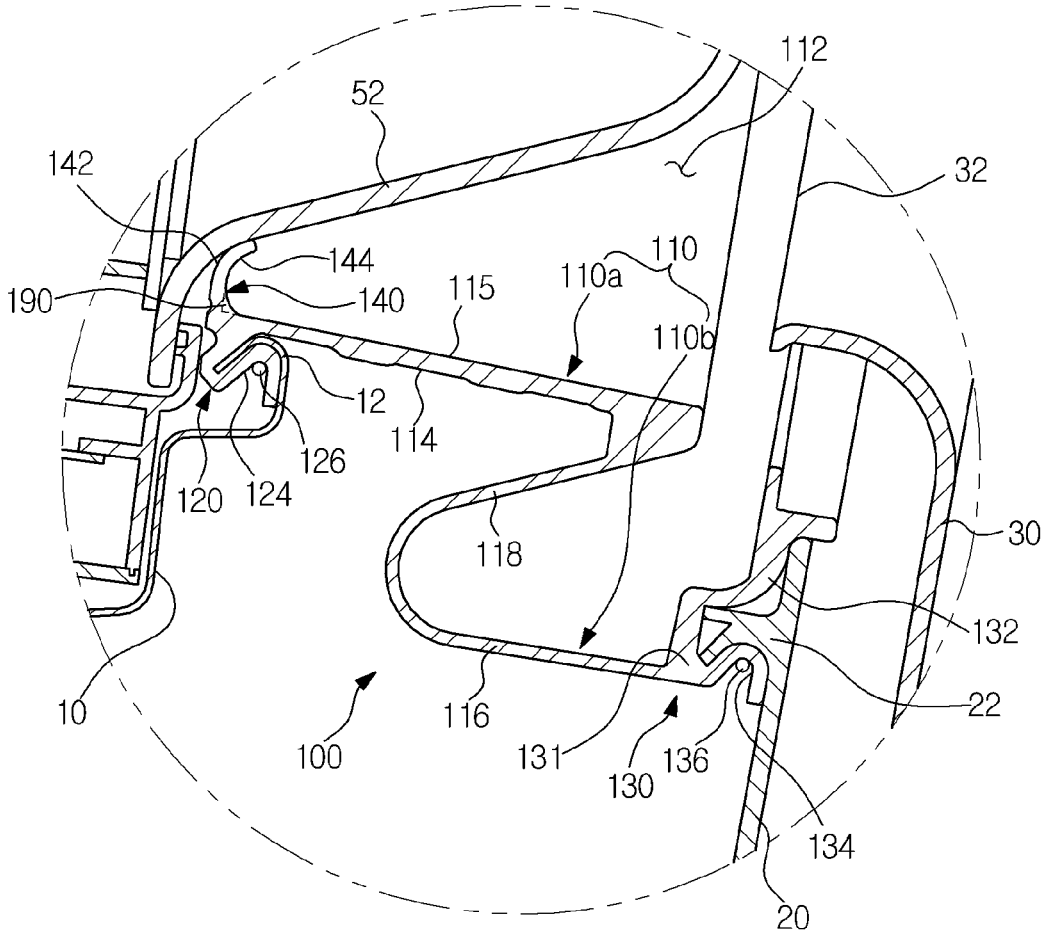
FIG. 3 is an enlarged view of a portion of FIG. 1.
Figure 4:
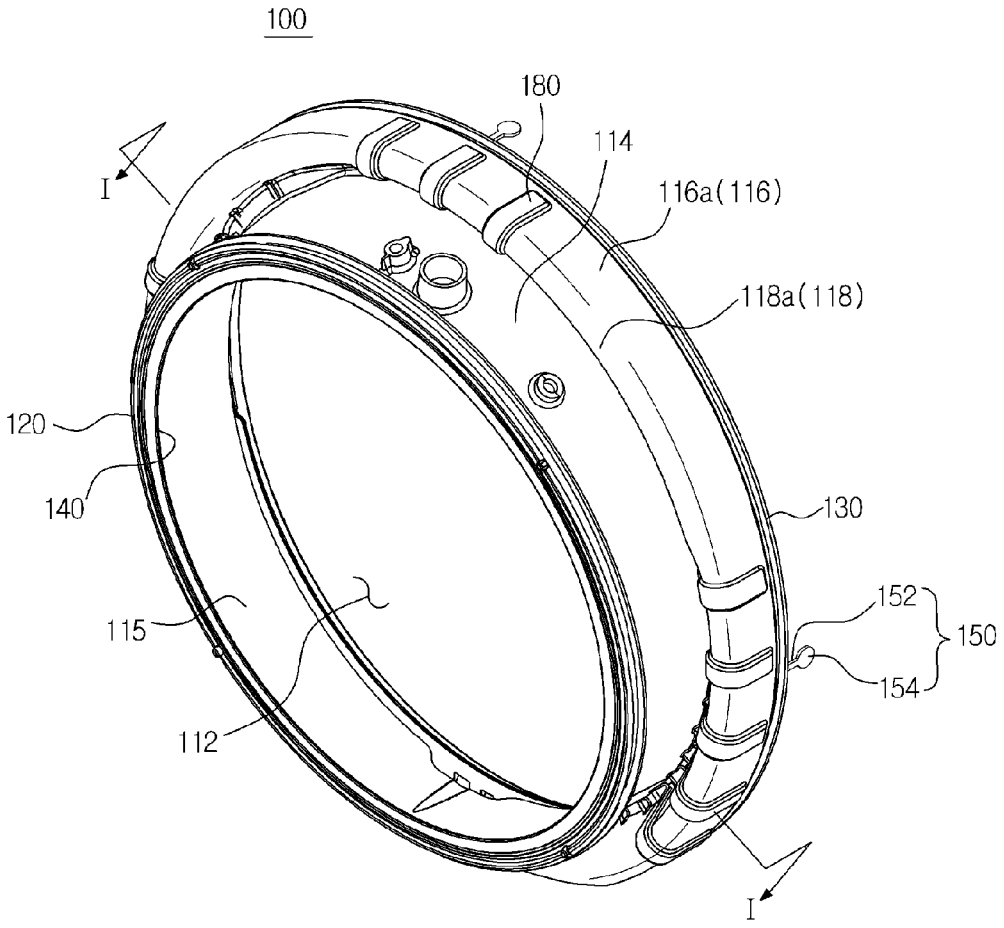
FIG. 4 is a perspective view illustrating a gasket in accordance with one embodiment.
Figure 5:
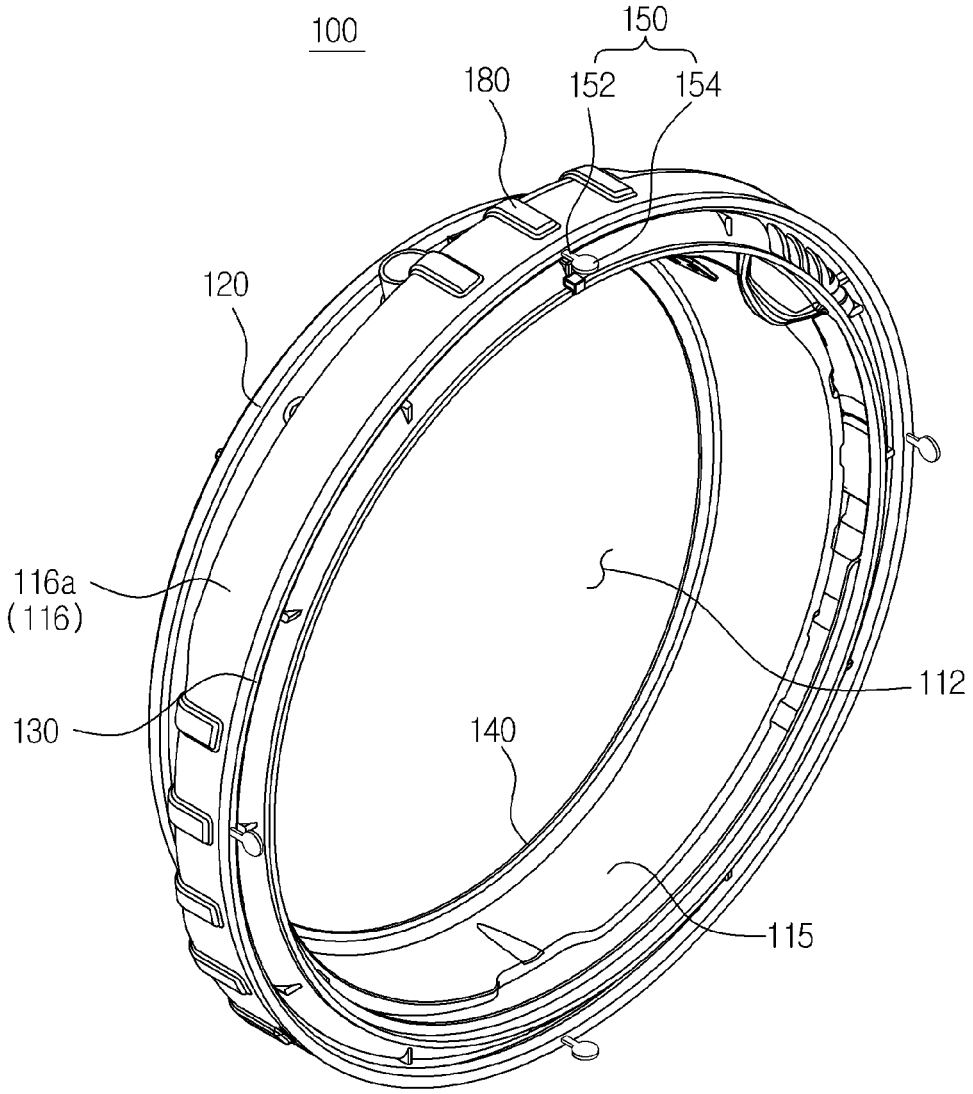
FIG. 5 is a rear side perspective view illustrating the gasket in accordance with one embodiment.

FIG. 3 is an enlarged view of a portion of FIG. 1. FIG. 4 is a perspective view illustrating a gasket in accordance with one embodiment. FIG. 5 is a rear side perspective view illustrating the gasket in accordance with one embodiment.

Referring to FIGS. 2 to 5, the gasket 100 is provided with a body 110 that is disposed between the opening 12 of the front surface frame 10*a* and the opening 32 of the drum 30 when the gasket 100 is mounted at the washing machine 1. The body 110 includes a hollowness part 112 serving as a path through which laundry is inserted and withdrawn, and periphery parts 114 and 116 configured to surround the hollowness part 112. When the door 50 is closed, the door glass 52 is accommodated in the hollowness part 112 of the gasket 110.

The body 110 includes a first body part 110*a* and a second body part 110*b* each provided in a cylindrical shape. A front end of the first body part 110*a* is coupled to the opening 12 of the front surface frame 10*a*, and a rear end of the first body part 110*a* is located adjacent to the opening 22 of the tub 20.

The second body part 110*b* has a diameter larger than that of the first body part 110*a*. A rear end of the second body part 110*b* is coupled to the opening 22 of the tub 20, and a front end of the second body part 110*b* is located in front of the rear end of the first body part 110*a*. Hereinafter, the periphery part 114 of the first body part 110*a* is referred to as a first periphery part, and the periphery part 116 of the second body part 110*b* is referred to as a second periphery part.

The rear end of the first body part 110*a* is connected to the front end of the second body part 110*b* through a connection part 118. The connection part 118 has a structure that is bent by a plurality of number of times so as to effectively attenuate the vibration being transmitted from the tub 20 to the cabinet 10. The connection part 118 joins the rear end of the first body part 110*a* at a connection joint that has a thickness greater than the rest of the first body part 110*a*.

A cabinet coupling part 120 is provided at the front end of the first body part 110*a* such that the front surface frame 10*a* of the cabinet 10 is coupled to the cabinet coupling part 120. The cabinet coupling part 120 includes a cabinet coupling groove 122 provided at an outer side of a radial direction of the first periphery part 114, and a first wire groove 124 provided at an outer side of the cabinet coupling groove 122. A rim of the front surface frame 10*a* forming the opening 12 is coupled to the cabinet coupling groove 122. A wire is 126 is coupled to the first wire groove 124 to prevent the gasket 100 from being separated from the cabinet 10.

In addition, a lip 140 is formed at the front end of the first body part 110*a*. The lip 140 protrudes from an inner surface 115 of the first periphery part 114 toward the hollowness part 112, and is provided in the form of a ring along a circumferential direction of the first periphery part 114. A front surface 142 of the lip 140 faces the door 50 and a rear surface 144 at the back of the front surface 142 faces the drum 30. When the door 50 of the washing machine 1 is closed, the front surface 142 of the lip 140 makes contact with the door glass 52 and performs a sealing, thereby preventing water from leaking into between the door 50 and the front surface frame 10*a* of the cabinet 10.

A tub coupling part 130 is provided at the rear end of the second body part 110*b*. The tub coupling part 130 includes a first flange 131 extending from the second periphery part 116 to the tub 20, and a second flange 132 extending from the second periphery part 116 to the drum 30.

A tub coupling groove 133 is formed between the first flange 131 and the second flange 132, and a second wire groove 134 is provided at an outer surface of the first flange 131. A rim of the tub 20 forming the opening 22 is coupled to the tub coupling groove 133. A wire 136 is coupled to the second wire groove 134 to prevent the gasket 100 from being separated from the tub 20. The tub comprises a plurality of protrusions that extend in to the tub coupling groove 133.

In addition, a hardness measurement piece 150 is formed at the rear end of the second body part 110*b*. The hardness measurement piece 150 includes a neck part 152 protruding from an end portion of the second flange 132 to a rear side, and a grip part 154 connected to the neck 152. The neck part 152 has a width that is narrow enough for the neck part 152 to be easily separated from the end portion of the second flange 132. An operator grasps the grip part 154 and pulls with a predetermined strength of force to separate the hardness measurement piece 150 from the gasket 100, and measures the hardness of the hardness measurement piece 150, thereby checking the hardness of the gasket 100. The hardness measurement piece 150 is provided in plurality thereof disposed along the end portion of the second flange 132 while being spaced apart from each other. An operator separates the plurality of hardness measurement pieces 150 from the gasket 100, and measures the hardness in a state of having the plurality of hardness measurement pieces 150 piled up, so that hardness of the gasket 100 is more precisely attained.

The gasket 100 molded of the thermoplastic elastomer may have hardness according to Korean Industrial Standards (KS)M6518 of about 30 to 50. If the hardness is below 30, the mechanical strength such as tensile strength is inferior, and if the hardness exceeds 50, the vibration transmitted to the cabinet 10 is not effectively attenuated.

Figure 6:
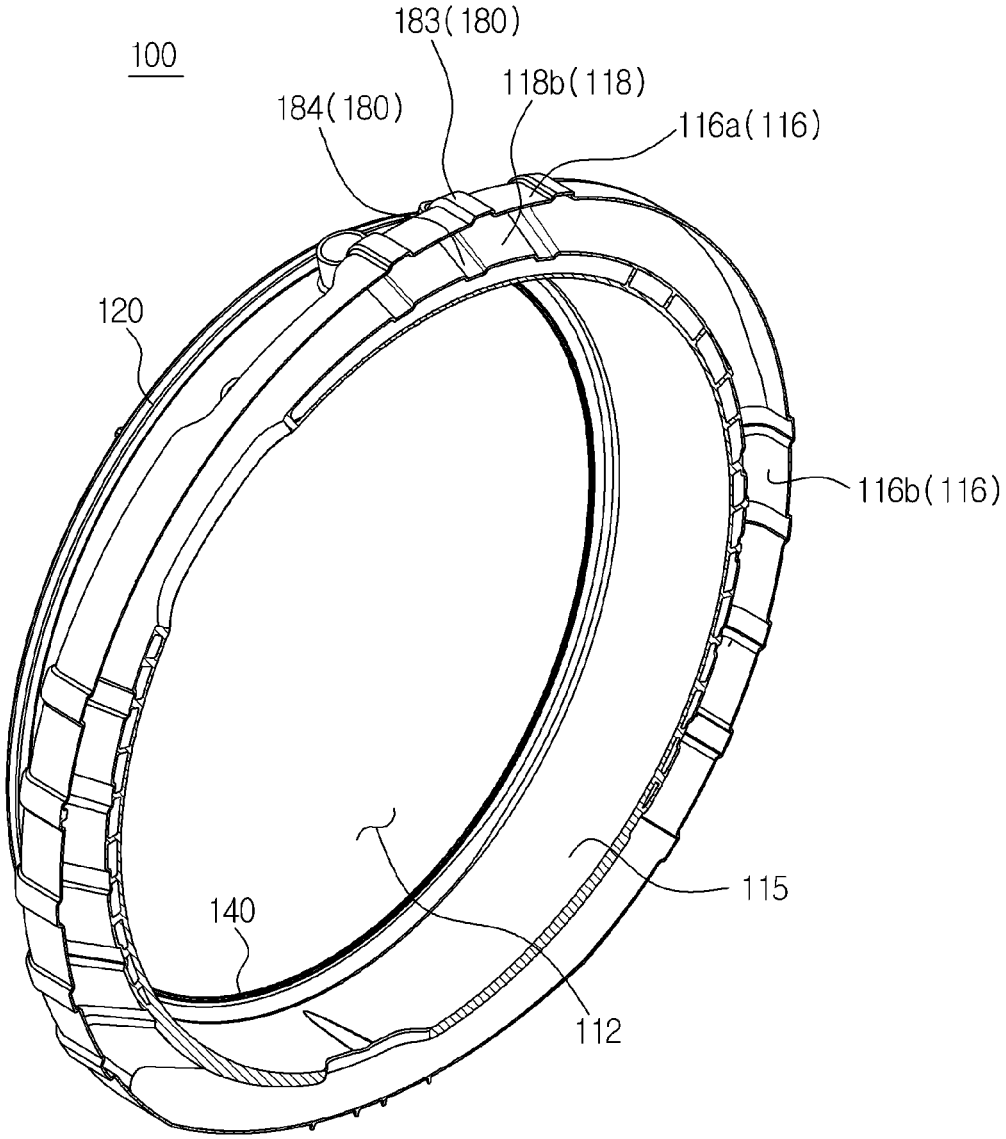
FIG. 6 is a drawing of a cut portion of the gasket in accordance with one embodiment.
Figure 7:
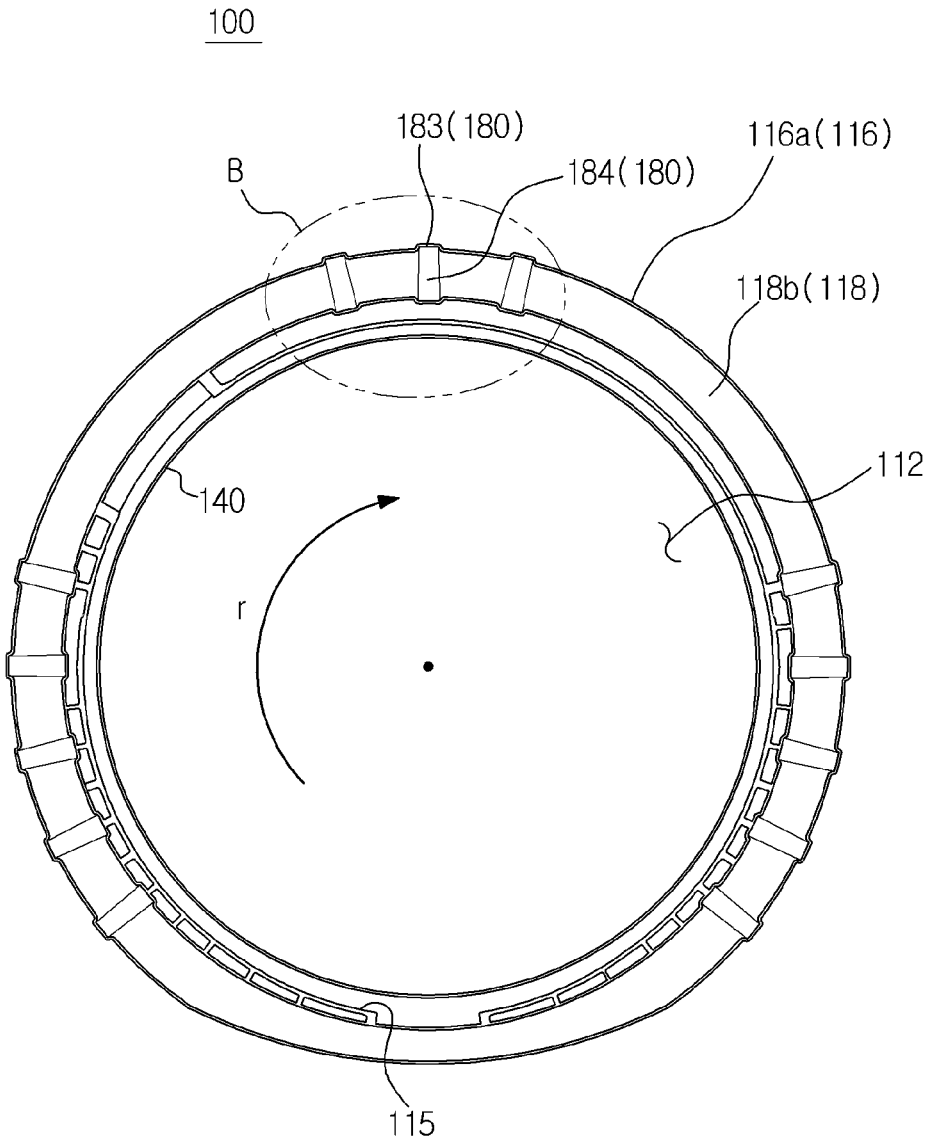
FIG. 7 is a rear view of FIG. 6.
Figure 8:
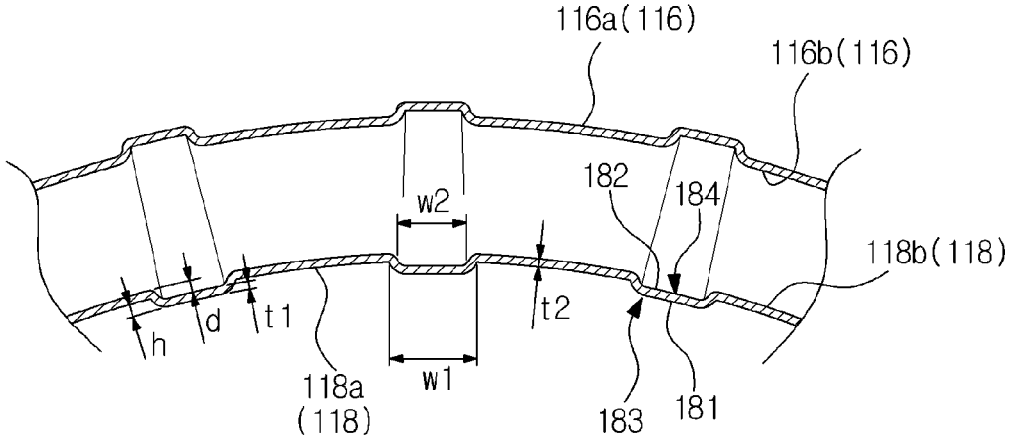
FIG. 8 is an enlarged view of portion 'B' of FIG. 7.
Figure 9:
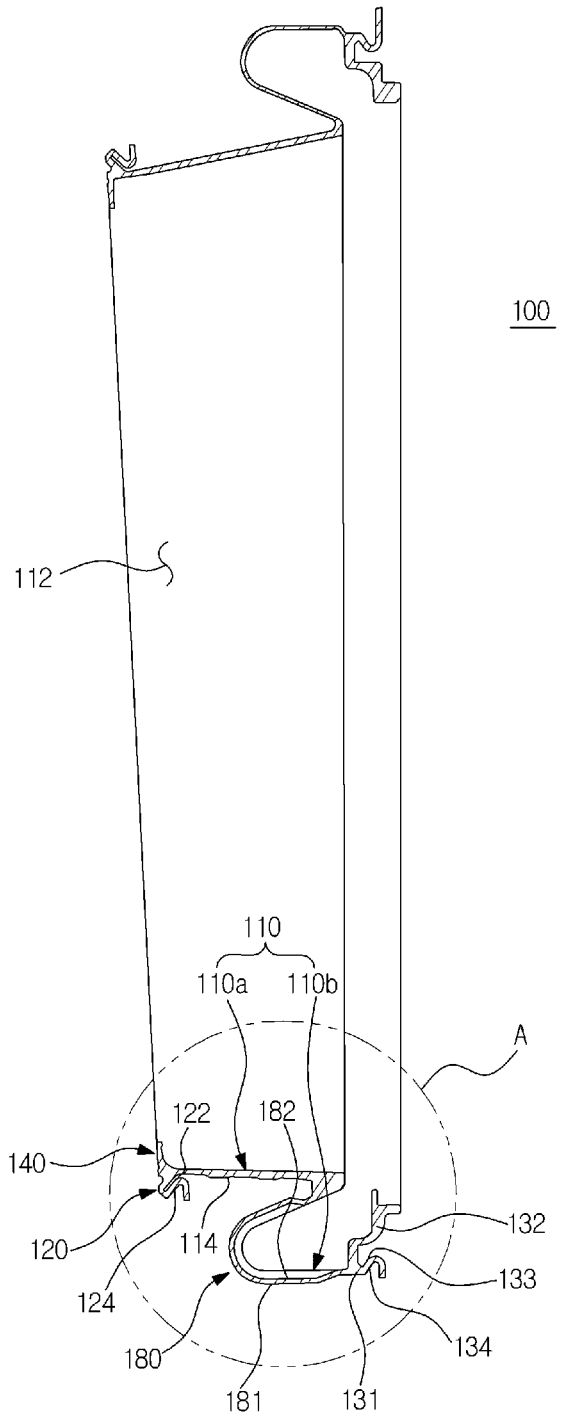
FIG. 9 is a cross sectional view taken along line 'I-I' of FIG. 4.
Figure 10:
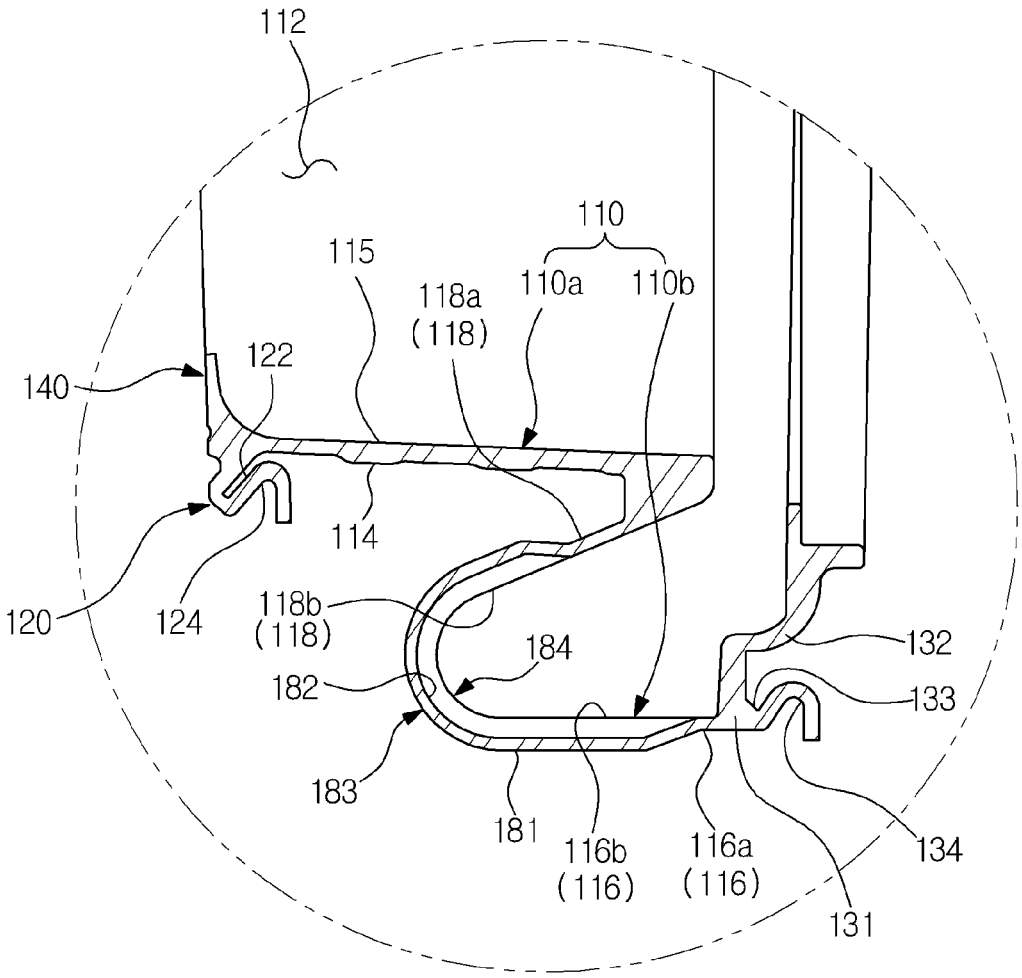
FIG. 10 is an enlarged view of portion 'A' of FIG. 9.

FIG. 6 is a drawing of a cut portion of the gasket in accordance with one embodiment. FIG. 7 is a rear view of FIG. 6. FIG. 8 is an enlarged view of 'B' portion of FIG. 7. FIG. 9 is a cross sectional view taken along line 'I-I' of FIG. 4. FIG. 10 is an enlarged view of 'A' portion of FIG. 9.

Referring to FIGS. 2 to 10, a plurality of reinforcing ribs 180 are dispersed around the gasket, formed on a side surface of the body 110 to reinforce the gasket 100.

The reinforcing rib 180 is formed by protruding at least one portion of the second body part 116 and the connection part 118 toward an outer side of the second body part 116 and the connection part 118.

The reinforcing rib 180 is provided in the form of a rectangular band along the second body part 116 and the connection part 118. The reinforcing rib 180 is provided at an outer surface 181 thereof with a convex part 183 bulging when compared to outer surfaces 116*a* and 118*a* of the second body part 116 and the connection part 118, and at a rear surface 182 thereof corresponding to the outer surface 181 with a concave part 184 concaved when compared to inner surfaces 116*b* and 118*b* of the second body part 116 and the connection part 118. At least one portion of the convex part 183 and the concave part 184 extend along the second body part 116 in an approximate axial direction of the body 110, and at least the other portion of the convex part 183 and the concave part 184 extends along the connection part 118 toward an approximate inner side of the body 110.

The convex part 183 has a width w1 in a circumferential direction of the outer surfaces 116*a* and 118*a* of the second body 116 and the connection part 118, and has a height h with respect to the outer surfaces 116*a* and 118*a* of the second body part 116 and the connection part 118. The concave part 184 has a width w2 in a circumferential direction of the inner surfaces 116*b* and 118*b* of the second body 116 and the connection part 118, and has a depth d with respect to the inner surfaces 116*b* and 118*b* of the second body part 116 and the connection part 118.

As described above, the connection part 118 has a structure bent by a plurality of numbers of times, thereby effectively preventing the vibration from being transmitted from the tub 20 to the front surface frame 10*a* of the cabinet 10. The connection part 118 converts vibration energy of the tub 20 being generated due to rotation of the drum 30 into thermal energy and sound energy by deforming its shape, and absorbs the converted energy. Referring to FIG. 10, when the tub 20 vibrates, the connection part 118 is bent at a bent portion thereof to deform its shape. Since at least one portion of the reinforcing rib 180 extends along the connection part 118 in an axial direction of the drum 30 to reinforce the bending stress of the connection part 118 generated in the bending direction of the connection part 118, thereby preventing self-touch between the connection part 118 and the first periphery part 114 of the first body part 110*a* and thus preventing the gasket 100 from being worn.

The relationship between the height h of the convex part 183, that is, the amount of the outer surface 181 of the reinforcing rib 180 protruding toward an outer side of the second body part 116 and the connection part 118 and the depth d, that is, the amount of the rear surface 183 of the reinforcing rib 180 protruding toward an outer side of the second body part 116 and the connection part 118 may vary with the design specification of the gasket 100.

For example, if a higher vibration reduction characteristic is required when compared to the strength characteristic of the gasket 100, the height h of the convex part 183 is adjusted to be smaller than the depth d of the concave part 184. Having the height h of the convex part 183 smaller than the depth d of the concave part 184 represents that a thickness t1 of the reinforcing rib 180 is smaller than a thickness t2 of the second body part 116 and the connection part 118. If the thickness t1 of the reinforcing rib 180 is thinner, the amount of deformation of the connection part 118 is larger, the vibration being transmitted from the tub 20 to the front surface frame 10*a* of the cabinet 10 is more effectively absorbed and reduced. In addition, the weight of the gasket 100 and the material cost for the gasket 100 are reduced as much as a portion at which the concave part 184 is formed.

Meanwhile, if a higher strength characteristic is required when compared to vibration reduction characteristic of the gasket 100, the height h of the convex part 183 is adjusted to be smaller than the depth d of the concave part 184. Having the height h of the convex part 183 smaller than the depth d of the concave part 184 represents that the thickness t1 of the reinforcing rib 180 is substantially equal to or larger than the thickness t2 of the second body part 116 and the connection part 118. If the thickness t1 of the reinforcing rib 180 is thicker, the bending stress is reinforced and the amount of deformation of the connection part 118 is smaller, thereby reducing self-touch between the connection part 118 and the first periphery part 114 of the first body part 110*a* and self-touch noise that may occur as the connection part 118 is bent due to the deformation of the gasket 100 when the drum 30 rotates at an inside the tub 20.

As described above, the thickness t1 of the reinforcing rib 180 and the thickness t2 of the second body part 116 may be each adjusted to be in a range of about 1 mm to about 3 mm such that the gasket 100 effectively absorbs vibration being transmitted from the tub 20 to the front surface frame 10*a* of the cabinet 10 while having a strength required to prevent the connection part 118 from making a self-touch with the first periphery part 114 of the first body part 110*a*.

In addition, the reinforcing rib 180 is provided in at least two units thereof that are disposed while being spaced apart from each other in a rotation direction of the drum 30. Referring to FIG. 7, the convex part 183 and the concave part 184 of the reinforcing rib 180 expands and contracts in a circumferential direction r of the gasket 100 in a process of rotation of the drum 30, and through an expansion and contraction of the convex part 183 and the concave part 184, the vibration in a circumferential direction of the tub 20 occurring in a process of rotation of the drum is effectively attenuated.

The position at which the reinforcing rib 180 is formed is not limited to the second body part 116 and the connection part 118. Although not shown, the reinforcing rib 180 may be formed on at least one portion of the first body part 114 and the connection part 118, at least one portion of the first body part 114, or at least one portion of the second body part 116. Alternatively, the reinforcing rib 180 may be formed on at least one portion of the first body part 114, the connection part 118 and the second body part 116.

Figure 11:
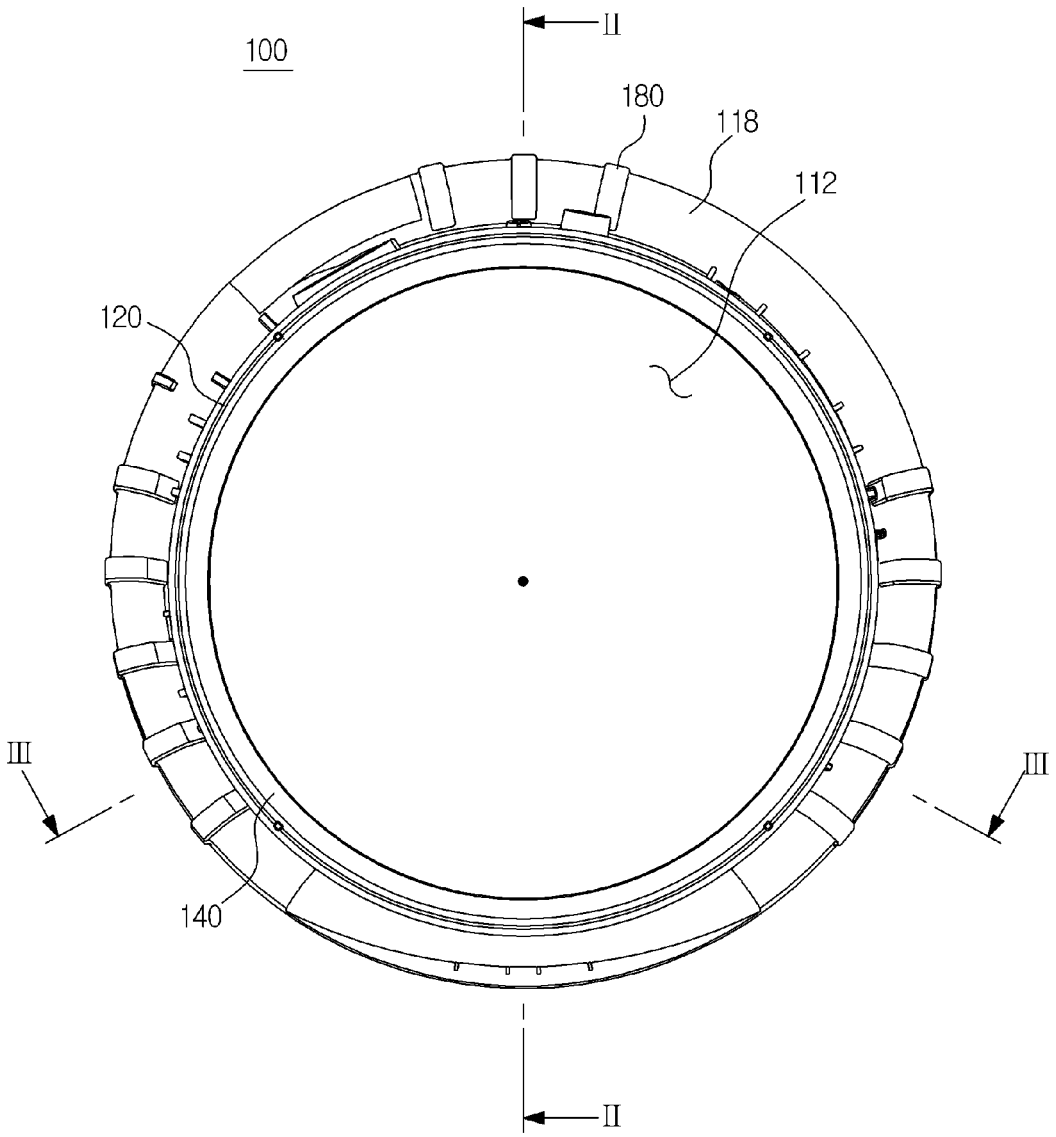
FIG. 11 is a front side view of a gasket in accordance with an embodiment.
Figure 12:
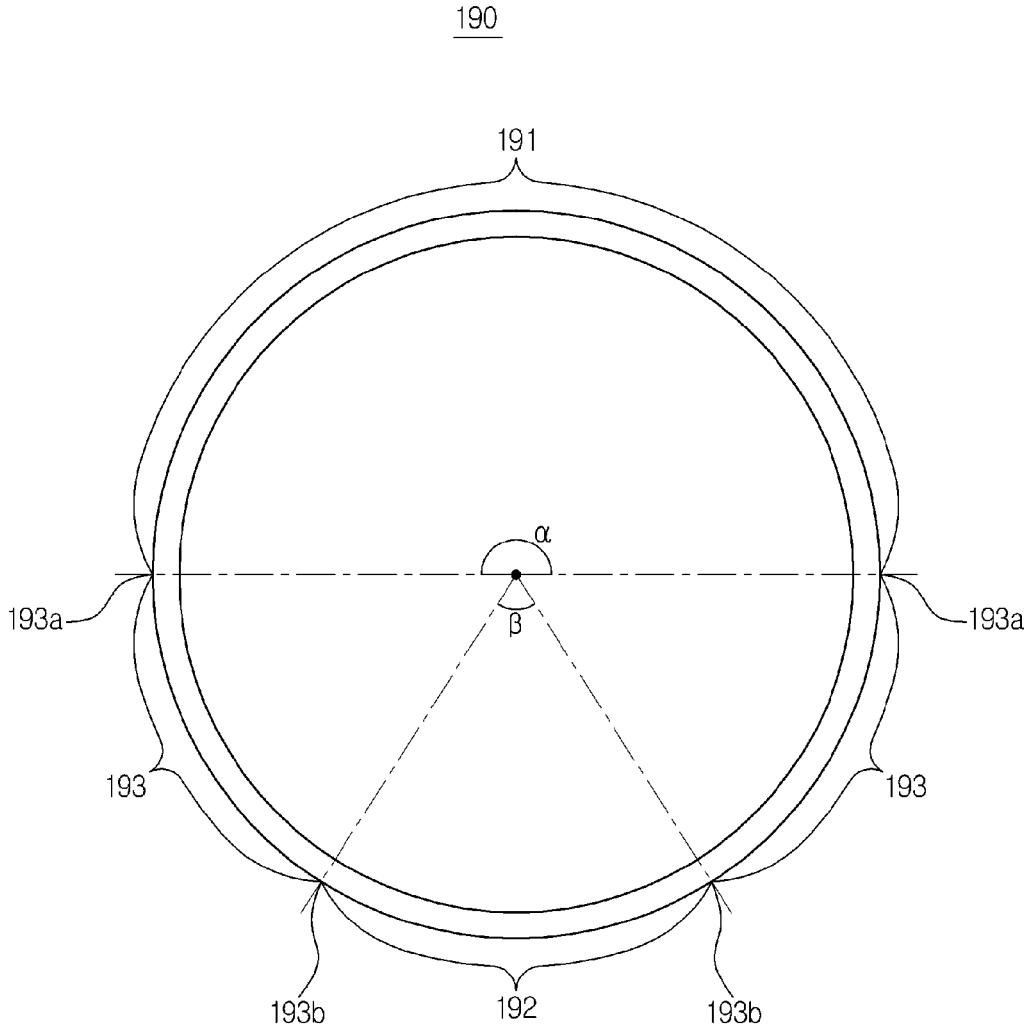
FIG. 12 is a drawing illustrating a connection rib of FIG. 11.
Figure 13:
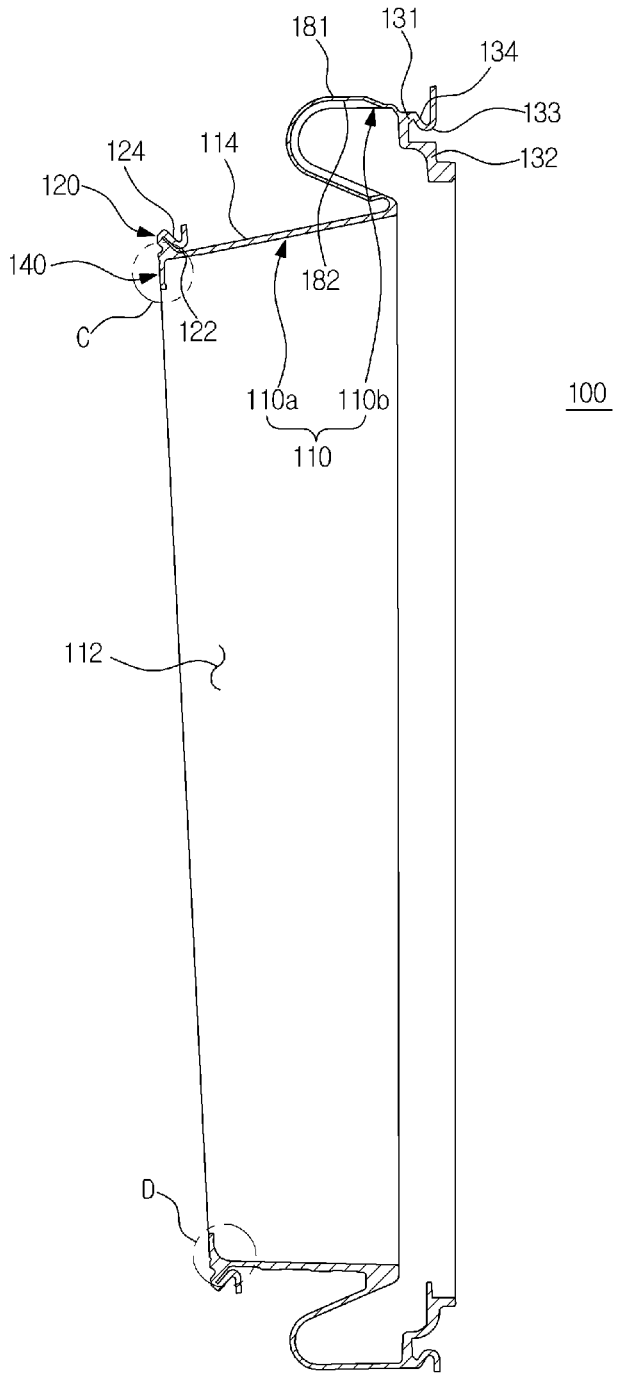
FIG. 13 is a cross sectional view taken along line 'II-II' of FIG. 11.
Figure 14:
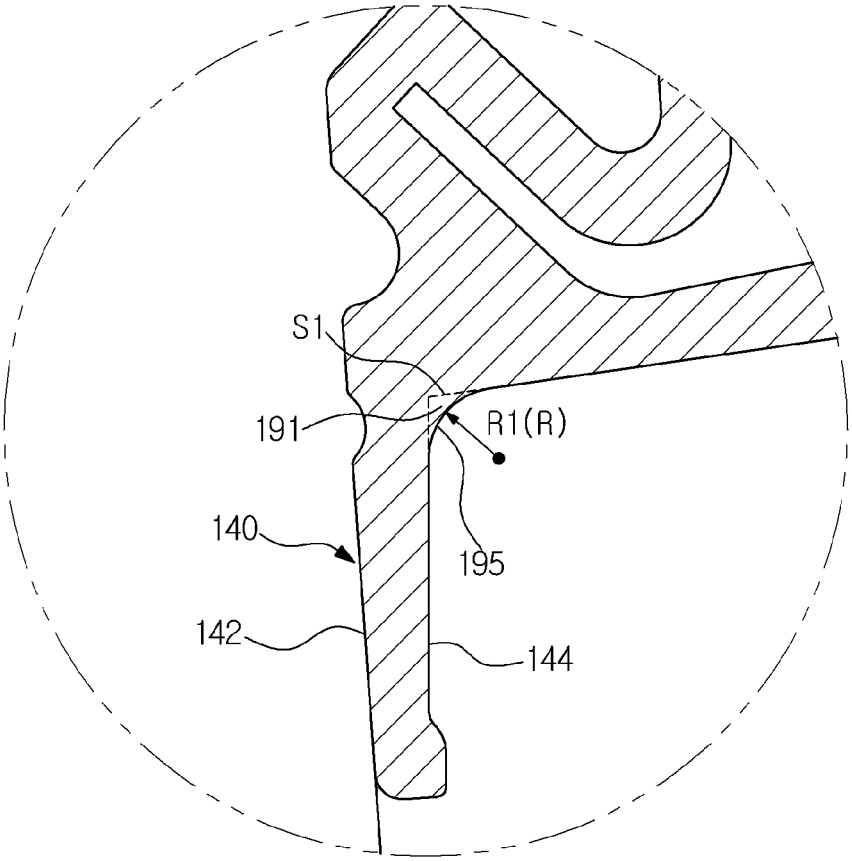
FIG. 14 is an enlarged view of portion 'C' of FIG. 13.
Figure 15:
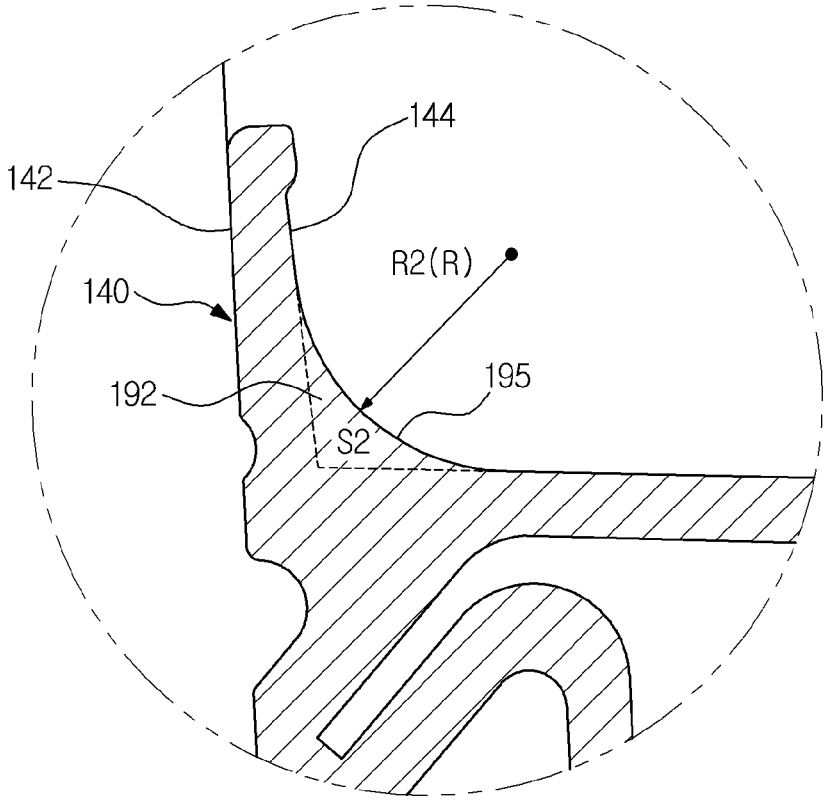
FIG. 15 is an enlarged view of portion 'D' of FIG. 13.
Figure 16:
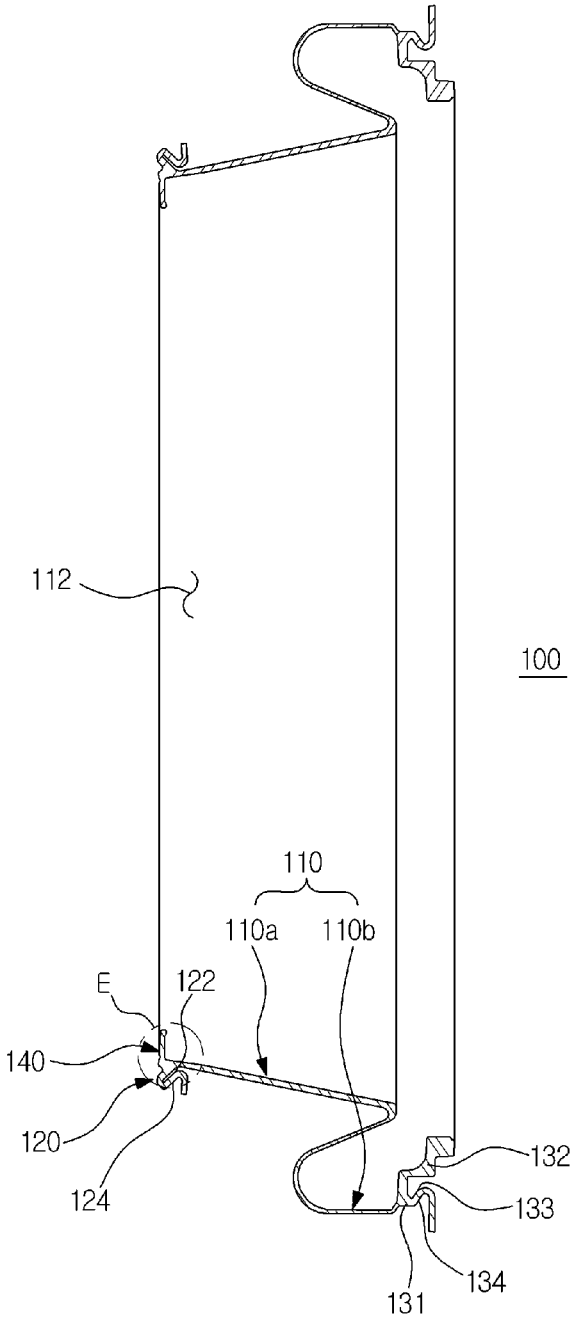
FIG. 16 is a cross sectional view taken along line 'III-III' of FIG. 11.
Figure 17:
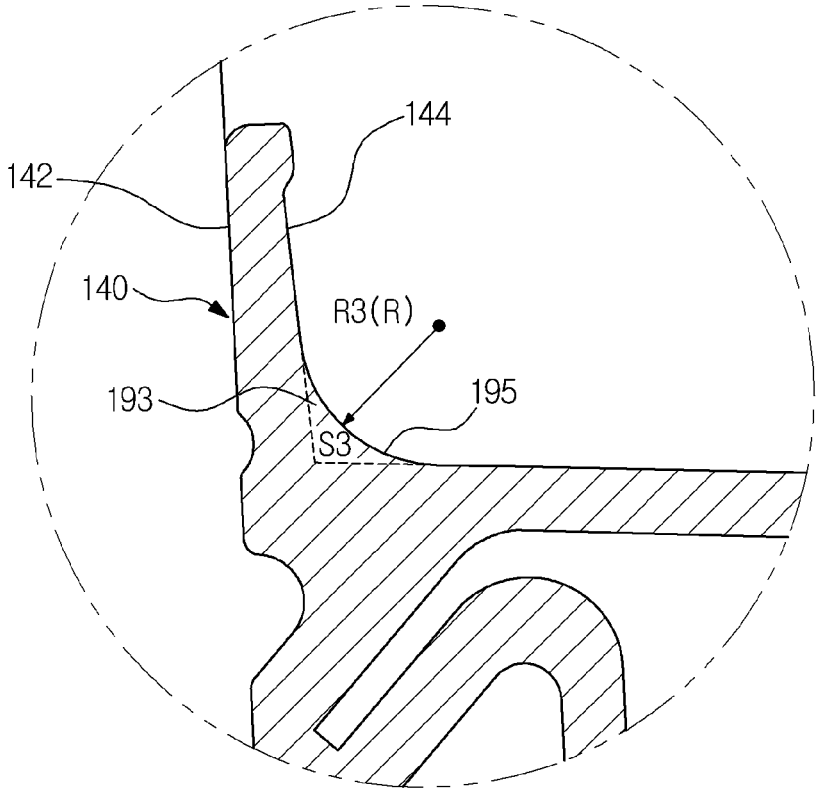
FIG. 17 is an enlarged view of portion 'E' of FIG. 16.

FIG. 11 is a front side view of a gasket in accordance with an embodiment. FIG. 12 is a drawing illustrating a connection rib of FIG. 11. FIG. 13 is a cross sectional view taken along line 'II-II' of FIG. 11. FIG. 14 is an enlarged view of portion 'C' of FIG. 13. FIG. 15 is an enlarged view of portion 'D' of FIG. 13. FIG. 16 is a cross sectional view taken along line 'III-III' of FIG. 11. FIG. 17 is an enlarged view of portion 'E' of FIG. 16.

Referring to FIGS. 11 to 17, a connection rib 190 is provided between the lip 140 and the first periphery part 114 so as to connect the rear surface 144 of the lip 140 to the inner surface 115 of the first periphery part 114.

The connection rib 190, as seen in FIG. 12, includes a first portion 191 having a first cross section S1 along a circumferential direction of the lip 140, a second portion 192 having a second cross section S2 larger than the first cross section S1 along the circumferential direction of the lip 140, and a third portion 193 connecting the first portion 191 to the second portion 192 and having a cross section continuously varying along the circumferential direction of the lip 140.

The first portion 191 forms an upper portion of the connection rib 190, the second portion 192 forms a lower portion of the connection rib 190, and the third portion 193 forms the remaining of the connection rib 190 between the first portion 191 and the second portion 192. An angle $\alpha$ formed by both ends of the first portion 191 along the circumferential direction of the lip 140 from a center point of gasket is about 150 degrees to about 210 degrees, and an angle $\beta$ formed by both ends of the second portion 192 along the circumferential direction of the lip 140 from the center point of the gasket is about 30 degrees to about 90 degrees. That is, the first portion 191 has a length longer than a length of the second portion 192 in the circumferential direction of the lip 140.

One end 193*a* of the third portion 193 is connected to the first portion 191, and the other end 193*b* of the third portion 193 is connected to the second portion 192. The one end 193*a* of the third portion 193 has a cross section S3 that is identical to the first cross section S1 of the first portion 191, and the other end 193*b* of the third portion 193 has a cross section S3 that is identical to the second cross section S2 of the second portion 192. The cross section S3 of the third portion 193 is continuously increased from the one end 193*a* of the third portion 193 to the other end 193*b* of the third portion 193. Accordingly, when a user closes the door 50, the lip 140 is naturally bent in a direction of the door 50 being closed, without being broken or folded.

If the cross section of the connection rib 190 is large, the repulsive force of the lip 140 acting in an opposite direction to the closing direction of the door 50 is high, and on the contrary, if the cross section of the connection rib 190 is small, the repulsive force of the lip 140 acting in an opposite direction to the closing direction of the door 50 is weak. If the repulsive force of the lip 140 is high, a force applied to a surface of the door glass 52 of the door 50 is high, which lowers the possibility of water leakage occurring between the lip 140 and the door 50, and increases the force required when a user closes the door 50. On the contrary, if the repulsive force of the lip 140 is weak, a force applied to a surface of the door glass 52 of the door 50 is low, which increases the possibility of water leakage occurring between the lip 140 and the door 50, and decreases the force required when a user closes the door 50.

When the washing machine 1 performs a washing operation, wash water is located at a lower side of the tub 20 and a lower side of the gasket 100 (see FIG. 1) in a horizontal or inclined washing machine. A region between the lower side of the gasket 100 and the door 50 has a higher possibility of water leakage when compared to a region between an upper side of the gasket 100 and the door 50. Accordingly, the repulsive force of the lip 140 at the lower side of the gasket 100 needs to be larger than the repulsive force of the lip 140 at the upper side of the gasket 100. To this end, the second portion 192 forming the lower portion of the connection rib 190 corresponding to the lower portion of the lip 140 is provided to have the second cross section S2 larger than the first cross section S1 of the first portion 191, thereby stably preventing water leakage that may occur between the lower side of the gasket 100 and the door 50.

If all the cross sections of the connection rib 190 along the circumferential direction of the lip 140 are maintained as the second cross section S2, an excessively great force is required to close the door 50 due to the repulsive force of the lip 140. Accordingly, the first portion 191 forming the upper portion of the connection rib 190 corresponding to the upper portion of the lip 140 is provided to have the first cross section S1 smaller than the second cross section S2 of the second portion 192, so that a user may close the door 50 with a small force. Furthermore, by transitioning the cross section from S1 to cross section S2 by increasing the crossing through the third portion 193 allows for an increasing repulsive force to be applied by the lip 140 that is exposed to large quantities of water.

The connection rib 190 may include a round part 195. The round part 195 enables the lip 140 to be bent in a closing direction of the door 50 when a user closes the door 50, while naturally coming into contact with the door glass 52 without being folded in the closing direction of the door 50 (see, for example, FIGS. 3, 14 and 15).

Preferably, the round part 195 has a radius R of about 1 mm to about 9 mm. If the radius R of the round part 195 is smaller than 1 mm, the lip 140 may be folded in the closing direction of the door 50 when a user closes the door 50. In addition, in this case, the repulsive force of the lip 140 is small, and thus water leakage may occur between the door 50 and the gasket 100. If the radius R of the round part 195 is larger than 9 mm, the repulsive force of the lip 140 in a direction opposite to the closing direction of the door 50 is excessively increased, and thus a force required to close the door 50 is excessively increased or the door 50 may not be closed.

A radius R1 of the round part 195 at the first portion 191 is smaller than a radius R2 of the round part 195 at the second portion 192.

If the radius R of the round part 195 is larger, the repulsive force of the lip 140 acting in an opposite direction to the closing direction of the door 50 is stronger, and if the radius R of the round part 195 is smaller, the repulsive force of the lip 140 acting in an opposite direction to the closing direction of the door 50 is weaker.

As described above, the repulsive force of the lip 140 at the lower side of the gasket 100 needs to be larger than the repulsive force of the lip 140 at the upper side of the gasket 100. To this end, the round part 195 at the second portion 192 forming the lower portion of the connection rib 190 corresponding to the lower portion of the rib 140 is provided to have the radius R2 larger than the radius R1 of the round part 195 at the first portion 191, thereby stably preventing water leakage that may occur between the lower side of the gasket 100 and the door 50.

If all the radiuses R of the connection rib 190 along the circumferential direction of the lip 140 are maintained as a second radius R2, an excessively great force is required to close the door 50 due to the repulsive force of the lip 140. Accordingly, the round part 195 at the first portion 191 forming the upper portion of the connection rib 190 corresponding to the upper portion of the rib 140 is provided to have a radius R1 smaller than a radius R2 of the round part 195 at the second portion 192, so that a user may close the door 50 with a small force.

The round part 195 at the one end 193*a* of the third portion 193 formed between the first portion 191 and the second portion 192 has a radius R3 that is identical to the radius R1 of the round part 195 at the first portion 191, and the round part 195 at the other end 193*b* of the third portion 193 has a radius R3 that is identical to the radius R2 of the round part 195 at the second portion 192. The radius R of the round part 195 at the third portion 193 is continuously increased from the one end 193*a* of the third portion 193 to the other end 193*b* of the third portion 193. Accordingly, when a user closes the door 50, the lip 140 is naturally bent in a direction of the door 50 being closed, without being broken or folded.

Although the above description has been made in relation to an example of a drum washing machine applied with a gasket in accordance with the aspect of the present disclosure, the present disclosure is not limited thereto. The gasket in accordance with the aspect of the present disclosure may be applied to a clothe drier or a combination of drier and washer.

As described above, a reinforcing rib is formed at a side surface of a gasket, and a rear surface of the reinforcing rib is more depressed than an inner surface of the gasket that is adjacent to the rear surface, thereby improving the vibration reducing performance while reinforcing the strength thereof.

In addition, the gasket is lightweight and has low material cost.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:

a cabinet comprising a front surface frame through which an opening is formed;

a door installed at the cabinet to open and close the opening;

a tub disposed at an inside the cabinet;

a drum rotatably disposed at an inside the tub; and a gasket connecting the tub to the front surface frame so as to inhibit vibration of the tub from being transmitted to the front surface frame when the drum rotates, wherein the gasket comprises:

a body including a hollowness part configured to accommodate a portion of the door, a periphery part configured to surround the hollowness part including a first body part coupled to the front surface frame, a second body part coupled to the tub, and a connection part connecting the first body part to the second body part, and a plurality of reinforcing ribs formed by protruding a plurality of portions of the second body part and the connection part so as to reinforce a strength of the gasket, and wherein at least one of the plurality of reinforcing ribs has a rear surface further concaved than an inner surface of the periphery part that is adjacent to the rear surface.

2. The washing machine of claim 1, wherein at least some of the plurality of reinforcing ribs are spaced apart from each other in a circumferential direction of the periphery part.

3. The washing machine of claim 1, wherein at least one of the plurality of reinforcing ribs is in a form of a rectangular band that winds around the periphery part.

4. The washing machine of claim 1, wherein at least one of the plurality of reinforcing ribs is formed on at least one portion of the first body part.

5. The washing machine of claim 1, wherein at least one of the plurality of reinforcing ribs is formed on at least one portion of the first body part and the connection part.

6. The washing machine of claim 1, wherein at least one of the plurality of reinforcing ribs has a thickness substantially identical to a thickness of the connection part.

7. The washing machine of claim 1, wherein at least one of the plurality of reinforcing ribs has a thickness thinner than a thickness of the connection part.

8. The washing machine of claim 1, wherein the gasket further comprises:

a lip protruding from an inner surface of the periphery part toward a center of the gasket while being formed in a ring shape along a circumferential direction of the gasket; and a round part formed between a rear surface of the lip and the inner surface of the connection part, wherein the round part comprises a first portion and a second portion that have different radiuses from each other.

* * * * *